United States Patent [19]

Nicastro

[11] Patent Number: 4,489,628

[45] Date of Patent: Dec. 25, 1984

[54] MULTISIZED FASTENER DRIVING TOOL

[76] Inventor: Hector M. Nicastro, 13019 Kenyon, Chesterland, Ohio 44026

[21] Appl. No.: 405,392

[22] Filed: Aug. 5, 1982

[51] Int. Cl.[3] ..... B25B 13/58

[52] U.S. Cl. ..... 81/185; 81/DIG. 11; 81/177 N

[58] Field of Search ..... 81/177 R, 177 E, 177 G, 81/177 N, 180, 185, 120, 121 A, 121 R, DIG. 11

[56] References Cited

U.S. PATENT DOCUMENTS

| | | | |
|---|---|---|---|
| 1,171,063 | 2/1916 | Nigborowicz . | |
| 1,997,948 | 4/1935 | Pearson | 81/185 |
| 2,502,587 | 4/1950 | Phipps | 81/185 |
| 2,735,325 | 2/1956 | Rudd | 81/71 |
| 2,822,714 | 2/1958 | Paparelli | 81/71 |
| 3,127,797 | 4/1964 | Rogers | 81/58.3 |
| 3,127,798 | 4/1964 | Gol | 81/185 X |
| 3,233,482 | 2/1966 | Jaehne | 81/185 |
| 3,651,720 | 3/1972 | Indyck | 81/121 |

*Primary Examiner*—Frederick R. Schmidt
*Assistant Examiner*—Debra S. Meislin
*Attorney, Agent, or Firm*—Fay & Sharpe

[57] ABSTRACT

The multisized fastener driving tool includes a plurality of sockets slidably received one within the other. A first or outer most socket (A) includes a plurality of first fastener engaging portions (20, 22, 24) for engaging alternate corners of a fastener driving surface and a plurality of first guideways, one positioned between each of the first fastener engaging portions. A second socket (B) includes a plurality of second fastener engaging portions (50, 52, 54) which are slidably received in the first guideways and are adapted to engage the driving surface of a smaller fastener. A third socket (C) includes a plurality of fastener engaging portions (80, 82, 84) which are slidably received in the second guideways and the first fastener engaging portions for engaging a still smaller fastener. Additional sockets may be provided for accommodating yet smaller fasteners. An end cap (E) is configured to be connected with a ratchet drive or the like. When the driving tool is received on a fastener, the sockets which are too small to engage the fasteners driving surfaces are biased inward against a plurality of springs (F).

9 Claims, 7 Drawing Figures

MULTISIZED FASTENER DRIVING TOOL

BACKGROUND OF THE INVENTION

This invention pertains to the art of driving tools for threaded mechanical fasteners and, more particularly, to drivers for accommodating a multiplicity of sizes of fasteners. The invention finds particular application in sockets for hexagonal headed bolts and nuts and will be described with particular reference thereto. It is to be appreciated, however, that the invention is also applicable to duodecimal sockets, square sockets, Allen wrenchs, Phillips screw drivers and the like.

Heretofore, various multiple socket driving tools, such as telescoping socket wrenches, have been proposed. Commonly, these wrenches included a plurality of hexagonal sleeves slidably received within each other. Because each sleeve corresponded to a different nut or bolt head size, the thickness of the hexagonal sleeves was limited to one half the difference in the diameter of adjacent fastener sizes to be accommodated. To accommodate common nut and bolt sizes which were relatively close in size, the prior art multiple socket wrenches commonly had relatively thin walled hexagonal sleeves. Exemplarly prior art multiple socket wrenches are illustrated in U.S. Pat. No. 1,171,063 to Nigborowicz, U.S. Pat. No. 1,997,948 to Pearson, and U.S. Pat. No. 3,233,482 to Jaehne.

Applying analogous principles, multiple socket driving tools were also made for Allen screws and the like. Note for example U.S. Pat. No. 2,735,325 to Rudd or U.S. Pat. No. 3,651,720 to Indyck. These principles have also been adapted for use in conjunction with Phillip screws, note for example U.S. Pat. No. 2,822,714 to Paparelli.

One of the problems with the prior art multiple socket driving tools is that the thin walls of the hexagonal sleeves are relatively easy to deform. Deformation of one of the cylindrical sleeves not only renders that sleeve inoperative for driving fasteners but can permanently interlock it with adjacent sleeves.

Another problem encountered with the prior art multiple socket driving tools resides in a tendency to jam or stick. Dirt tends to become lodged in the thin gap between adjacent sleeves, jamming them. Further, the large area of functional engagement between adjacent sleeves provides relatively high frictional resistance to relative sliding movement. Jamming and sticking are further aggravated when the torque applied to a nut or bolt moves the hexagonal sleeves out of circumferential alignment.

The present invention provides a new and improved multiple socket driving tool which overcomes the above referenced problems and others.

SUMMARY OF THE INVENTION

In accordance with a first aspect of the present invention there is provided a driving tool for driving any one of a plurality of preselected size threaded fasteners which have a plurality of driver engaging surfaces arranged in a regular geometric array. The driving tool includes a first socket which has a plurality of circumferentially spaced first fastener engaging portions for engaging a preselected fraction of the driver engaging geometric array of a first size fastener and having a plurality of first guideways disposed circumferentially between at least some of the first fastener engaging portions. A second socket has a plurality of circumferentially spaced second fastener engaging portions for engaging a preselected fraction of the driver engaging geometric array of a second size fastener. The second fastener engaging portions are slidably received in the first socket guideways. A connecting means connects the first socket with a means for applying a rotational torque.

In accordance with another aspect of the invention, there is provided a driving tool for driving any one of at least first, second, and third size threaded fasteners. A first socket includes a plurality of circumferentially spaced first fastener engaging portions and a plurality of circumferentially spaced first guideways. The first fastener engaging portions and first guideways are alternately disposed. A second socket includes a plurality of circumferentially spaced second fastener portions which are received in an axial slidable relationship with the first guideways and a plurality of circumferentially spaced second guideways. The second fastener engaging portions and second guideways are alternately disposed. A third socket includes a plurality of circumferentially spaced third fastener engaging portions which are received in an axial slidable relationship with the second guideways and the first fastener engaging portions. A connecting means connects the first, second, and third sockets with means for applying rotational torque thereto.

BRIEF DESCRIPTION OF THE FIGURES

The invention may take form in various parts and arrangements of parts. The drawings are only for the purpose of illustrating a preferred embodiment of the invention and are not to be construed as limiting the invention.

BRIEF DESCRIPTION OF THE PREFERRED AND ALTERNATE EMBODIMENTS

The driving tool includes a first or outer socket portion A, a second socket portion B, a third socket portion C, and a fourth socket portion D slidably received one within the other. A connecting means E connects the sockets with a means for applying a rotational torque thereto, such as a ratchet or hand drive. A biasing means F biases the sockets to a fastener receiving position.

Figure 2:
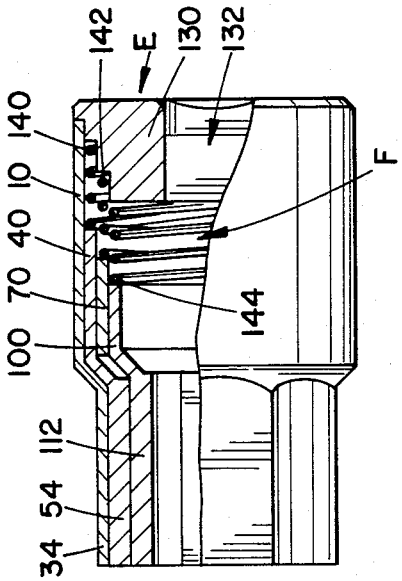
FIG. 2 is a side elevational view and partial section of a driving tool in accordance with the present invention.
Figure 3:
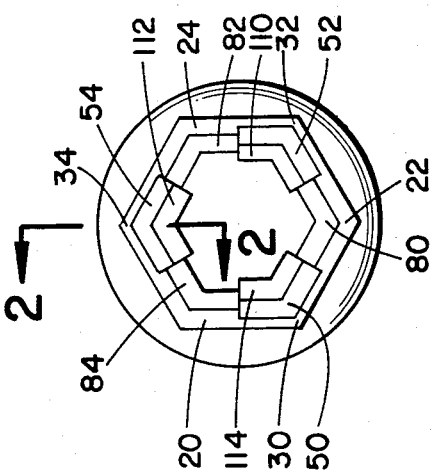
FIG. 3 is an end view from the fastener engaging end of the driving tool of FIG. 2.
Figure 1:
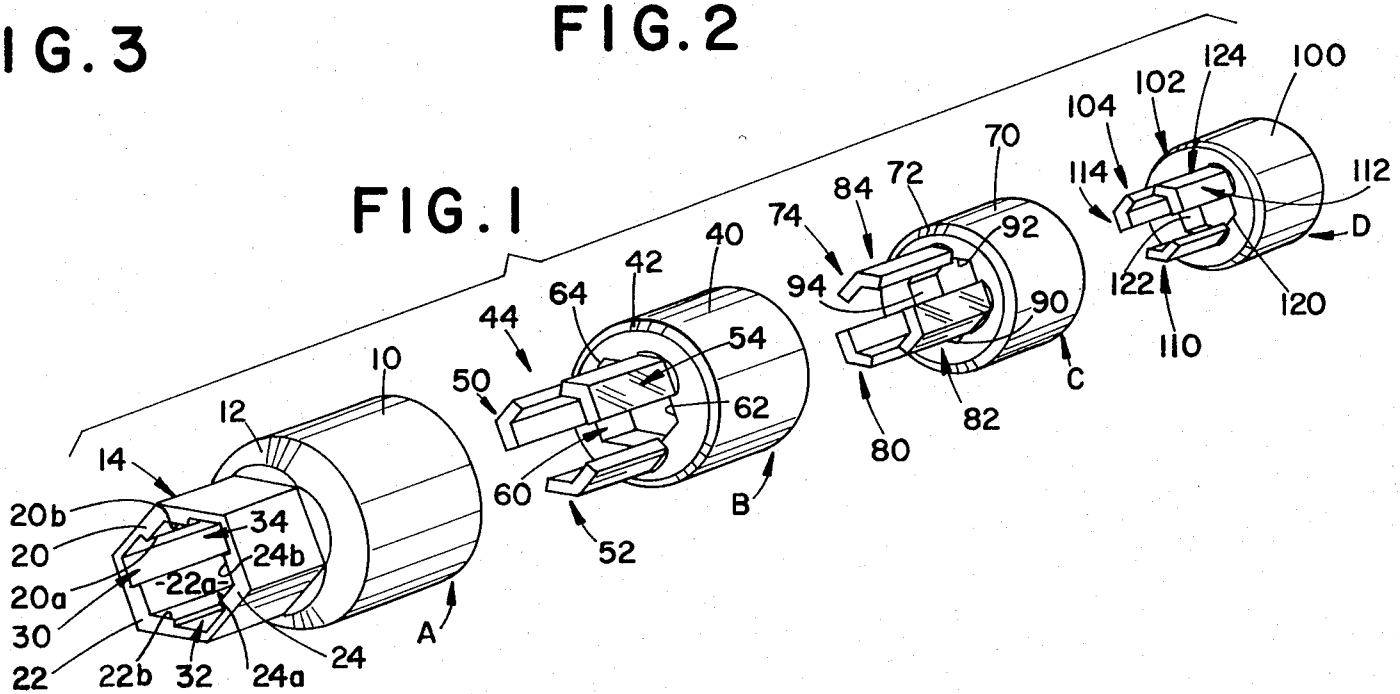
FIG. 1 is an exploded view of a driving tool in accordance with the present invention.

With particular reference to FIGS. 1, 2, and 3, the first socket A includes a first cylindrical body portion 10, a first shoulder portion 12, and a first fastener engaging end 14. The first fastener engaging end 14 defines a plurality of circumferentially spaced first fastener engaging portions 20, 22, and 24. A plurality of circumferentially spaced first guideways 30, 32, and 34 are axially disposed between each of the first fastener engaging portions. In this manner, the first fastener engaging portions engage about half of the driver engaging surface area of a fastener. More specific to the preferred embodiment in which the engaged fastener is hexagonal, the first fastener engaging portions include fastener engaging surfaces 20*a*, 20*b*; 22*a*, 22*b*; and 24*a*, 24*b*, which are disposed at 120° angles relative to each other for engaging alternate corners of a hexagonal fastener. Alternately, the first socket A can be constructed to engage fasteners with other than hexagonal cross sections by adjusting the number of first fastener engaging portions and first guideways appropriately.

The second socket B includes a second cylindrical body portion 40, a second shoulder portion 42, and a second fastener engaging end 44. The second body portion 40 is cylindrical and dimensioned to be slidably received within the first body portion 10. The second shoulder portion 42 is adapted to abut an inner surface of the first shoulder portion 12 to limit the sliding movement between the first and second sockets. The second fastener engaging end 44 includes a plurality of circumferentially spaced second fastener engaging portions 50, 52, and 54. The second fastener engaging portions are configured to be slidably received in the first guideways 30, 32, and 34. A plurality of circumferentially spaced second guideways are disposed alternately with the second fastener engaging portions. The second guideways are configured to have inward facing surfaces of the same transverse cross section as inward facing surfaces as the first fastener engaging surfaces.

The third socket C includes a third body portion 70, a third shoulder portion 72, and a third fastener engaging end 74. The third body portion is cylindrical and dimensioned to be slidably received in the second body portion 40. The third shoulder portion 72 is adapted to abut an inside surface of the second shoulder portion 42 to limit the sliding motion of the third socket with second socket. The third fastener end 74 includes a plurality of circumferentially spaced third fastener engaging portions 80, 82, and 84 which are dimensioned to be axially, slidably received in the second guideways 60, 62, and 64, respectively, and the first fastener engaging portions 22, 24, and 20, respectively. A plurality of circumferentially spaced third guideways 90, 92, and 94, are disposed one between each of the third fastener engaging portions.

The fourth socket D includes a fourth body portion 100, a fourth shoulder portion 102, and a fourth fastener end 104. The fourth body portion 100 is cylindrical and dimensioned to be slidably received in the third body portion 70 with the fourth shoulder portion 102 abutting an inner surface of the third shoulder portion 72 to limit sliding movement. The fourth fastener end 104 includes a plurality of circumferentially spaced fourth fastener engaging portions 110, 112, and 114 which are configured to be slidably received in the third guideways 90, 92, and 94, respectively and the second fastener engaging portions 52, 54, and 50, respectively. A plurality of circumferentially spaced fourth guideways, including fourth guideways 120, 122, and 124 are disposed one between each of the fourth fastener engaging portions such that additional like configured sockets, not shown, may be received. In this manner, the number of different size fasteners which can be accommodated can be extended.

Figure 4:
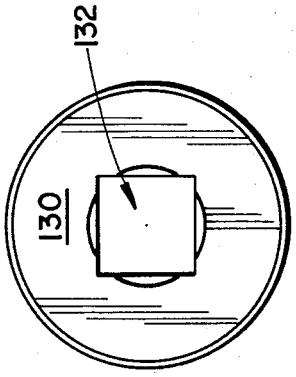
FIG. 4 is an end view from a ratchet engaging end of the driving tool of FIG. 2.

With particular reference to FIGS. 2 and 4, the connecting means E includes an end cap which is securely interconnected with the first socket A. The end cap 130 defines a rectangular aperture 132 therein for receiving a standard ratchet handle.

The biasing means F includes a plurality of coil springs 140, 142, and 144 for biasing the second, third, and fourth sockets toward their fastener ends until the shoulder portions engage.

Figure 5:
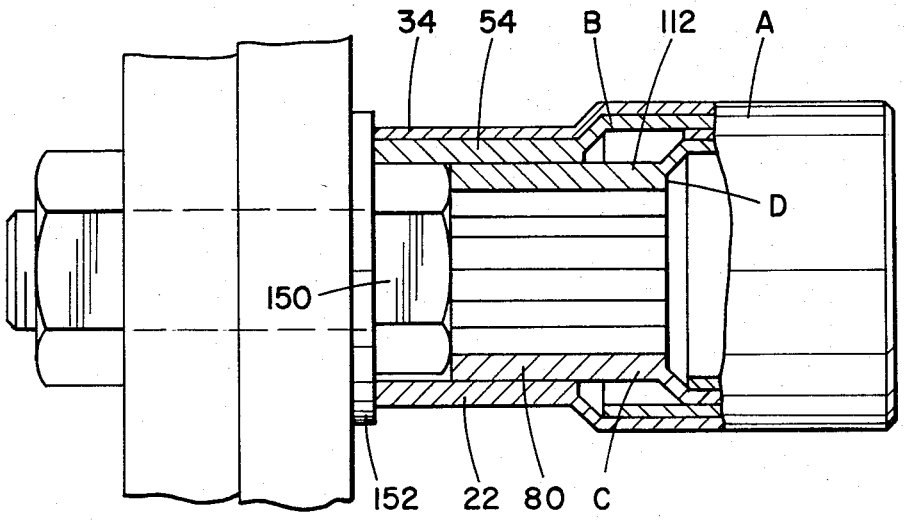
FIG. 5 is a side elevational view in partial section illustrating engagement between the driving tool of FIG. 2 and the head of a bolt.

In the embodiment of FIGS. 1 through 4, the driving tool is configured for interacting with a threaded fastener that has driver engaging surfaces arranged hexagonally around its periphery. With reference to FIG. 5, the driving tool is illustrated with the second socket B engaging a fastener, specifically a bolt head 150 in a driving interaction. As the driving tool is axially placed over the bolt head, the third and fourth fastener ends 74 and 104 engage the bolt head and the third and fourth sockets are urged against the biasing means and the first and second fastener ends rest on a washer 152. The second fastener engaging portions 50, 52, and 54, more specifically their inward facing surfaces, engage alternate corners of the fastener. A torque applied to the driving tool from a ratchet received in the end cap aperture 132 is transmitted to the first socket. The interaction of the first guideways and the second fastener engaging portions transmits the torque from the first socket to the second socket, hence to the fastener. Analogously, the guideways and fastener engaging portions interact to transmit the torque to the third, fourth and any subsequent sockets.

Although the fastener in the preferred embodiment was constructed with a plurality of driver engaging surfaces facing outward and arranged in a regular geometric array, specifically hexagonal. The invention is also applicable to fasteners which have driver engaging surfaces arranged around a recess in the fastener facing inward in a regular geometric array, such as an Allen screw.

Figure 7:
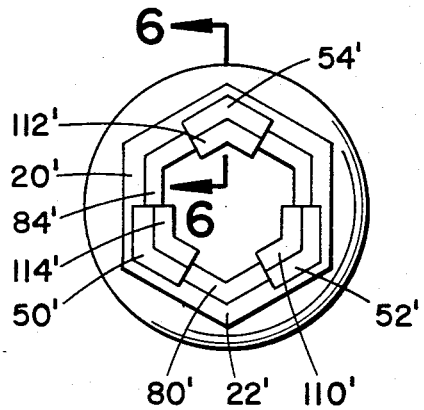
Figure 6:
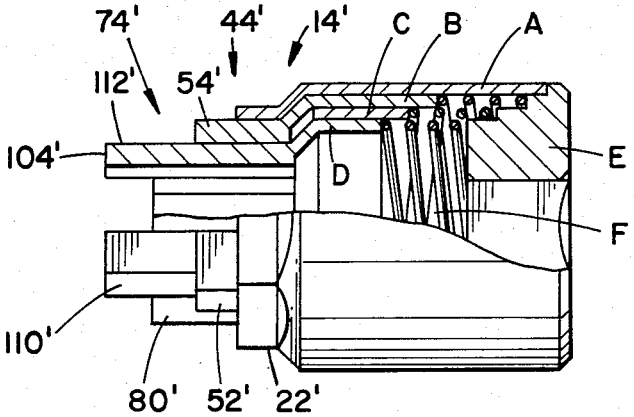
FIG. 6 is a side elevational view in partial section of an alternate embodiment of a driving tool in accordance with the present invention; and, FIG. 7 is an end view from a fastener engaging end of the driver of FIG. 6.

In FIGS. 6 and 7 an alternate embodiment for driving Allen screws is illustrated. In the embodiment of FIGS. 6 and 7, like elements with the embodiment of FIGS. 1 through 4 are illustrated with the same reference numeral but followed by a prime (′). In the embodiment of FIG. 6, the fourth socket fastener end 104′ extends axially beyond third socket the fastener end 74′ which in turn extends axially beyond the second socket fastener end 44′ which in turn extends axially beyond the first socket fastener end 14′. In this manner, the fastener ends of the smaller sockets engage the bottom of the driver receiving recess in the fastener and are urged against the biasing means F until the appropriate socket is received in driving engagement with the fastener.

The first socket fastener end 14′ includes first fastener engaging portions 20′, 22′ and 24′ the outward facing surfaces of which engage the fastener. The second socket fastener end 44′ includes second fastener engaging portions 50′, 52′, and 54′, the outward facing surfaces of which are adapted to engage the fastener. The third socket fastener end 74′ includes fastener engaging portions 80′, 82′, and 84′, the outward facing surfaces of which are adapted to engage a fastener. The fourth socket fastener end 104′ includes fourth fastener engaging portions 110′, 112′, and 114′, the outward facing surfaces of which are adapted to engage a fastener.

By way of example, the first fastener receiving surfaces may be dimensioned to engage alternate corners of a 1″ hexagonal fastener, the second fastener engaging surfaces may be dimensioned to engage alternate corners of a ¾" fastener, the third fastener engaging surfaces may be dimensioned to engage the exterior corners of a ½" fastener, and the fourth engaging surfaces may be dimensioned to engage alternate corners of a hexagonal ¼" fastener. As another example, the fastener engaging surfaces may be configured to engage 5/16, 11/16, 7/16, and 3/16 fasteners or the like. Alternately, the fastener engaging portions may be arranged to engage the corners of a square fastener. The fastener engaging surfaces may be configured in a generally square array to engage alternate surfaces of a fastener or may be arranged in a generally octagonal array to engage all corners of a square fastener. As yet another alternative, each of the socket assemblies may be configured with spaced fastener engaging portion arranged at alternate corners of a duodecagon to engage the corners of a hexagonal fastener and alternate corners of a square fastener.

The invention has been described with reference to the preferred and alternate embodiments. Obviously, modifications and alterations will occur to others upon reading and understanding the preceeding detailed description of the preferred embodiment. It is intended that the invention be construed as including all such alterations and modifications insofar as they come within the scope of the appended claims or the equivalents thereof.

Having thus described the preferred and alternate embodiments, the invention is now claimed to be:

1. A driving tool for driving any one of a plurality of preselected sized threaded fasteners, each fastener size having six driver engaging surfaces arranged in a hexagonal array and connected at six corners, the driving tool comprising:

a first socket having three circumferentially spaced first fastener engaging portions for engaging three of the six corners of a first sized fastener and defining three first guideways therebetween;

a second socket having three circumferentially spaced second fastener engaging portions for engaging three of the six corners of a second sized fastener, the second fastener engaging portions being slidably disposed in the first socket guideways; and, connecting means for connecting the first and second sockets with means for applying a rotational torque.

2. The driving tool as set forth in claim 1 wherein the second socket defines three second guideways disposed between the three second fastener engaging portions; and, further including a third socket having three circumferentially spaced third fastener engaging portions for engaging three of the six corners of a third sized fastener, the three third fastener engaging portions and the three first fastener engaging portions being slidably disposed relative to each other in the second socket guideways.

3. The driving tool as set forth in claim 2 wherein the third socket defines three third guideways disposed between the third fastener engaging portions; and, further including a fourth socket having three circumferentially spaced fourth fastener engaging portions for engaging three corners of a fourth sized fastener, the fourth fastener engaging portions and the second fastener engaging portions being slidably disposed relative to each other and relative to the third socket in the third socket guideways.

4. A driving tool comprising:

a first socket including a ring of axially extending, circumferentially spaced first fastener engaging portions and defining a plurality of axially extending, circumferentially spaced first guideways between the first fastener engaging portions, the first fastener engaging portions and first guideways being alternately disposed circumferentially;

a second socket including a ring of axially extending, circumferentially spaced second fastener engaging portions received in the first guideways in an axially slidable relationship therewith and with the first fastener engaging portions and defining a plurality of axially extending, circumferentially spaced second guideways, the second guideways receiving the first fastener engaging portions in axially slidable relationship therewith, the second fastener engaging portions and second guideways being alternately disposed circumferentially;

a third socket including a plurality of axially extending, circumferentially spaced fastener engaging portions received in the second guideways in an axially slidable relationship therewith and with the first and second fastener engaging portions; and, connecting means for connecting the first, second and third sockets with means for applying rotational torque thereto.

5. The driving tool as set forth in claim 4 wherein the third socket defines a plurality of axially extending third guideways, the third fastener engaging portions and the third guideways being alternately disposed circumferentially; and, further including a fourth socket including a plurality of axially extending, circumferentially spaced fourth fastener engaging portions received in an axially slidable relationship with the third guideways and the second fastener engaging portions.

6. The driving tool as set forth in claim 4 further including biasing means for biasing the second and third sockets axially within the first socket.

7. The driving tool as set forth in claim 4 wherein the first, second, and third sockets each have exactly three fastener engaging portions such that the fastener engaging portions of each socket are adapted to engage a hexagonal array of driver engaging surfaces disposed on a fastener.

8. The driving tool as set forth in claim 7 wherein each of the first, second, and third fastener engaging portions define a pair of fastener engaging surfaces angularly displaced by substantially 120° and wherein each of the first and second guideways define a pair of guideway surfaces angularly displaced from each other by substantially 120°.

9. A driving tool comprising:

a first socket including:

a first, axially extending, hollow, sleeve-like body portion;

a plurality of first-fastener engaging portions extending axially from the first body portion and substantially parallel to each other;

the first fastener engaging portions defining a plurality of axially extending first guideways therebetween;

a second socket including:

a second, axially extending, hollow, sleeve-like body portion disposed within the first body portion in an axially slidable relationship therewith;

a plurality of second fastener engaging portions extending axially from the second body portion and substantially parallel to each other, the second fastener engaging portions being disposed at least partially in the first guideways in an axially slidable relationship with the first fastener engaging portions;

the second fastener engaging portions defining a plurality of axially extending second guideways therebetween, the first fastener engaging portions being disposed partially within the second guideways in a slidable relationship with the second fastener engaging portions;

a third socket including:

a third body portion disposed within the second body portion in an axially slidable relationship therewith;

a plurality of third fastener engaging portions extending axially from the third body portion and substantially parallel to each other, the third fastener engaging portions being disposed partially in the second guideways adjacent and parallel to the first fastener engaging portions, the third fastener engaging portions being disposed in a slidable relationship with the first and second fastener engaging portions;

biasing means for biasing the second and third sockets axially relative to the first socket; and, connecting means for connecting the first, second, and third sockets with a means for applying rotational torque thereto.

* * * * *